US007832162B1

(12) United States Patent
Abdel-Rahman et al.

(10) Patent No.: US 7,832,162 B1
(45) Date of Patent: Nov. 16, 2010

(54) CORNER WALL STRUCTURE TO PREVENT CORNER DAMAGE

(75) Inventors: Nabil Abdel-Rahman, Raleigh, NC (US); Gary Bennett, Macon, NC (US); Michael Booth, Raleigh, NC (US)

(73) Assignee: The Steel Network, Inc., Raleigh, NC (US)

( * ) Notice: Subject to any disclaimer, the term of this patent is extended or adjusted under 35 U.S.C. 154(b) by 879 days.

(21) Appl. No.: 11/533,171

(22) Filed: Sep. 19, 2006

(51) Int. Cl.
*E04B 1/00* (2006.01)

(52) U.S. Cl. ..... 52/272; 52/254; 52/288.1

(58) Field of Classification Search ..... 52/272, 52/275, 278, 282.1, 282.3, 282.4, 254, 255, 52/256, 257, 631, 716.1, 287.1, 288.1, 290, 52/365

See application file for complete search history.

(56) References Cited

U.S. PATENT DOCUMENTS

| | | | | | |
|---|---|---|---|---|---|
| 1,881,805 | A * | 10/1932 | Mathers et al. | ..... | 52/255 |
| 3,632,146 | A * | 1/1972 | Buzby et al. | ..... | 52/285.2 |
| 3,713,257 | A * | 1/1973 | Beavers | ..... | 52/36.6 |
| 4,324,079 | A * | 4/1982 | Pearson | ..... | 52/255 |
| 5,138,810 | A * | 8/1992 | Kartler | ..... | 52/254 |
| 5,813,179 | A * | 9/1998 | Koenig et al. | ..... | 52/255 |
| 6,311,442 | B1 * | 11/2001 | Watanabe | ..... | 52/282.3 |
| 7,104,024 | B1 * | 9/2006 | diGirolamo et al. | ..... | 52/710 |
| 7,503,150 | B1 * | 3/2009 | diGirolamo et al. | ..... | 52/702 |
| 2005/0246986 | A1 * | 11/2005 | Dugger | ..... | 52/287.1 |
| 2006/0032157 | A1 * | 2/2006 | Baryla et al. | ..... | 52/167.1 |

OTHER PUBLICATIONS

Kersh, Jeffrey S.; Castle, Thomas; "Designing for Drift . . . Is Lateral Drift Accomodation in Exteriors Really Possible?", Structure Magazine, Jun. 2005, pp. 20-23.

* cited by examiner

*Primary Examiner*—Richard E Chilcot, Jr.
*Assistant Examiner*—Jessica Laux
(74) *Attorney, Agent, or Firm*—Coats & Bennett, P.L.L.C.

(57) ABSTRACT

A corner drift connector for preventing damage to exterior walls of buildings during wind, earthquake, or other building-deforming events is described. The corner drift connector is slidably attached to each of two angled walls which form a corner of a building. Slots in flanges of the corner drift connector facilitate utilizing connectors to attach the corner drift connector to the walls while allowing relative motion between the walls and the connector. A cover placed outside the corner drift connector conceals the connector and its intersections with the walls.

19 Claims, 3 Drawing Sheets

CORNER WALL STRUCTURE TO PREVENT CORNER DAMAGE

FIELD OF THE INVENTION

The present invention related to the field of building construction and specifically to the aspect preventing damage to the corners of buildings in high winds, earthquakes, and other building-deforming situations.

BACKGROUND OF THE INVENTION

Seismic events, high winds, or other mechanical disturbances pose the potential for major damage and even destruction of buildings. Design practices and building codes provide mitigating approaches to building design and construction that introduce some degree of lateral flexibility in buildings. This lateral flexibility allows buildings undergoing such events or disturbances to deform without being permanently damaged in any significant way from a basic structural standpoint. This deformation takes the form generally of lateral drift of the floors of the building. Lateral drift varies from floor to floor from the bottom to the top of the building. Drift generally increases from the bottom floor to the top floor such that there is relative lateral motion between consecutive floors. Lateral drift is, however, reversible. That is, when, for example, the high winds cease, such buildings will return to basically their original shape and retain their structural integrity. Floors move laterally back to their original positions one above the other.

The amount of lateral drift typical in such events depends upon the particular structural form of the building. In moment frame design, where floors are supported essentially by columns spaced throughout the building, the lateral stability of the building is dependent on the bending stiffness of the columns collectively. In such building designs, lateral floor-to-floor drifts of 2 to 3 inches are common under seismic loading. In steel braced or concrete shear wall designs, lateral stability is dependent upon various kinds of cross bracing or shear walls associated with vertical supports. In such structures under the same kind of seismic event, floor-to-floor drifts of 0.5 to 0.75 inches may be experienced.

Walls defining areas within such buildings, and particularly exterior walls enclosing the building, are commonly non load-bearing walls. Such non load-bearing walls will, for example, enclose a space between two adjacent floors, or a part of a story of the building. Walls are never anchored to both floors which define the story. Rather, walls are anchored, for example, to the lower floor and allowed to move relative to the upper floor. Such walls must accommodate relative lateral drift between floors. Lateral drift in the plane of a wall, for example, is accommodated by a slidable attachment of the wall to the upper floor such that when the floors drift relatively, the wall slides along with the lower floor. Designs to provide such slidable attachment include slotted slip tracks or nested tracks engaging the upper portions of the walls and connecting them to the upper floors. These designs provide a degree of rotational freedom of the wall relative to both the lower and upper floors as well as lateral slidability in the plane of the wall relative to the upper floor. These and similar extant connection approaches also accommodate any vertical relative movement of the floors which may occur in connection with the various kinds of building disturbing events. The accommodation of lateral drift is, however, the major concern.

Lateral drift in a direction out of the plane of a wall is accompanied by a tilting of the wall in the direction of the relative lateral drift. Rotational freedom provided by the lower and upper floor wall attachments allows a degree of tilting within limits. Lateral drift within the plane of a wall is accommodated by the wall sliding relative to the upper floor. This ability to slide derives from the slidable connection mentioned above. Any in-plane separations between adjacent co-planar walls are easily accommodated by extant devices such as flexible joints, tracks, and slotted clips. Where adjacent walls are not co-planar, for example at a corner, there is a problem in maintaining the integrity and appearance of the corner.

The problem with angled adjacent walls is most clearly understood by considering a simple right-angled building corner and by envisioning one story of a building. The walls are anchored to the floor as described above and meet at the 90 degree corner. The walls are generally connected at the corners and provided with enclosing trim or other corner treatment to seal the walls at the corner. The walls are slidably connected to the upper floor as described above. A lateral drift of the upper floor relative to the lower floor in a direction parallel to one wall will push the top of the other wall away from the corner. The other wall remains fixed to the floor and does not move away from the corner. As the wall being pushed away by the lateral drift of the top floor tilts and/or bends a generally triangular gap will occur at the corner. The apex of the triangular gap is at the lower floor level, and the gap becomes progressively wider towards the upper floor. This gaping damages the corner structure of the wall, compromising the integrity of the closure of the wall and creating an aesthetic deficit for the building. Practical means are needed to prevent such corner damage.

SUMMARY OF THE INVENTION

The invention comprises a corner wall structure of a building fabricated to prevent or reduce damage to the corner wall structure due to high winds, earthquakes, or other building-deforming events. The corner wall structure includes first and second non load-bearing walls disposed at an angle relative to each other and thereby forming a corner of the building. The walls are each slidably connected to a corner drift connector in such a way that the walls remain connected through the corner drift connector. However, due to the slidable connections with the corner drift connector, the walls may move relative to each other and relative to the connector.

The invention further comprises a method of connecting non load-bearing walls at corners such that relative motion of the walls is permitted during building-deforming events. Permitting relative motion between the walls prevents or limits damage to the walls during such events. The method includes fabricating and attaching the walls to the building structure, and slidably connecting the walls at the corners utilizing the corner drift connector described above.

Other objects and advantages of the present invention will become apparent and obvious from a study of the following description and the accompanying drawings which are merely illustrative of such invention.

DESCRIPTION OF THE DRAWINGS ILLUSTRATING THE INVENTION

DESCRIPTION OF THE INVENTION

Figure 1:
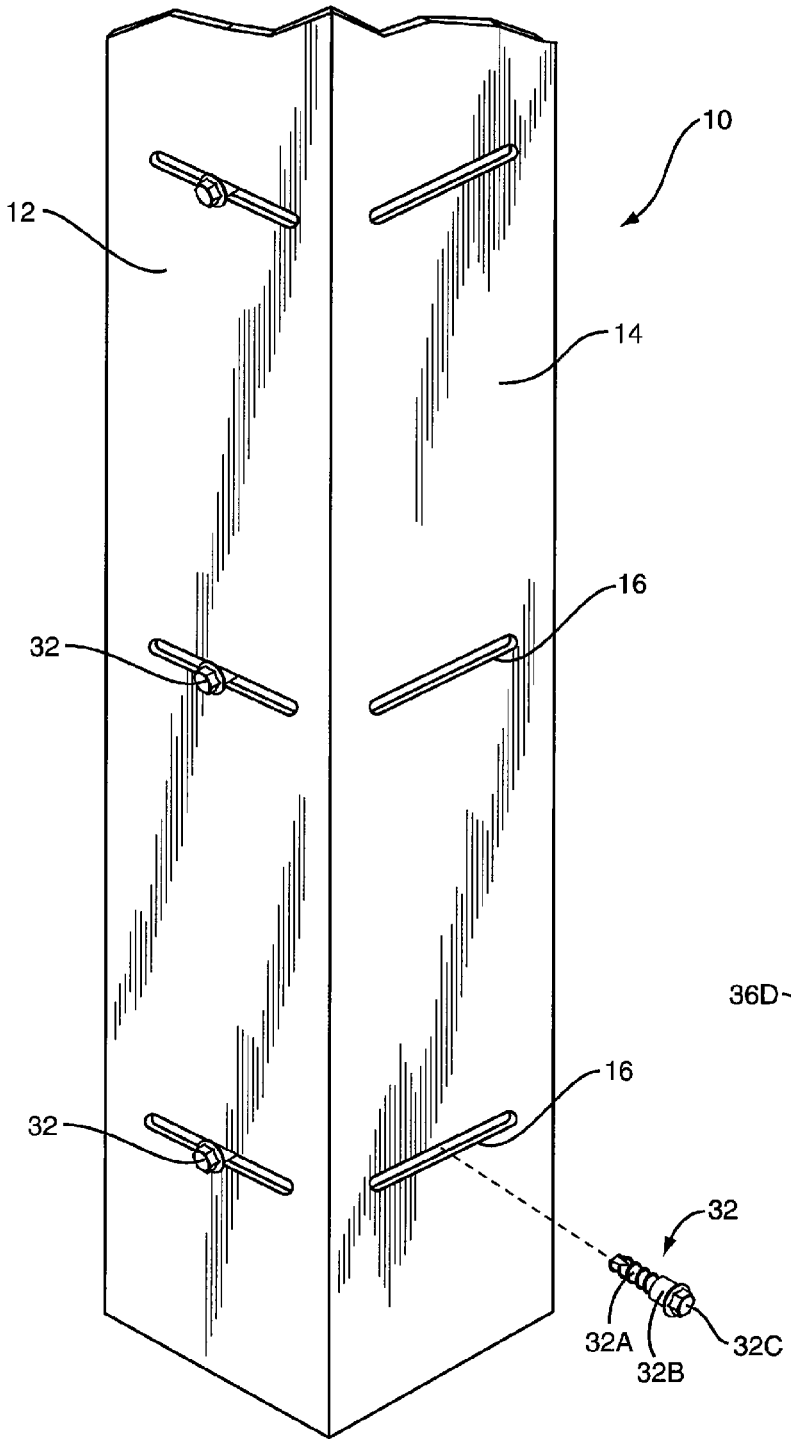
FIG. 1 is a fragmentary pictorial view of the corner drift connector.

The present invention relates to protecting corners between non-load bearing walls of a building from damage due to events which deform the building. Such events include high winds and earthquakes as well as any event which causes relative movement, or drift, between parts of the building. Design practice and building codes aimed at making buildings safer in such events require significant mechanical flexibility in the building structure. A typical kind of flexibility designed into buildings provides for reversible lateral drift of one floor of a building relative to an adjacent floor above or below. Relative drift, depending on the severity of the event, can range up to about 3 inches. Building practice also includes the use of non load-bearing walls which are attached to portions of the building but which do not significantly participate in supporting the general building structure. These walls function principally to separate and enclose areas of the building.

Building walls generally extend from one floor to the floor above, thus defining the spaces, or stories, between the floors. In order to prevent major and permanent damage to floors and walls of buildings constructed with the flexibility described above, it is a common practice to fixedly attach each wall to only one floor while keeping the wall movable relative to an adjacent floor. This practice and alternative means for accomplishing it are described in more detail in the Background of the Invention. When walls are thus installed, an event which causes a floor to drift horizontally in the plane of the wall, results in the wall attached to that floor moving with the floor. This arrangement prevents the wall from being sheared and perhaps destroyed as would be the case were the wall fixedly attached to both floors. Also, walls installed in the above fashion may tilt or bend out of plane when the drift is in the out of plane direction. This tilting or bending is made possible by a pivotal flexibility built into the connection of the walls with one or more floors, and within limits this tilting of bending of the wall results in no permanent damage to the wall itself. Moreover, it is appreciated that were the walls fixedly and rigidly attached to both adjacent floors, building flexibility and the resulting protection that flexibility provides, would be reduced.

There is, however, a problem that derives from the above described approach to building construction. The problem is illustrated, for example, in the case of exterior walls of a building. When first and second exterior walls are fixedly attached to the same floor and when they are at an angle to each other, the walls intersect forming a corner. This corner is seen as a generally vertical intersection of the two walls. When one floor moves horizontally relative to an adjacent floor and in a direction parallel to a first wall, for example, then this first wall moves in-plane and with the floor, sliding relative to the adjacent floor. The second wall, however, is constrained at its top to move out of plane and with the floor above while it moves out of plane at its bottom with the floor below thereby tilting. In such a case, the corner fails by breaking apart, forming a generally triangular gap between the walls at the corner. When the event causing the building deformation ends and the floors return to their normal positions. The triangular gap may partially close, but the damage to the corner is permanent, and the integrity of the building closure provided by the walls is compromised.

Turning now to a detailed description of the present invention and its application to solve the problem described above, it is first useful to establish some definitions of pertinent terms associated with the invention. These terms and their definitions are listed below:

Non load-bearing wall: a wall which carries no load associated with supporting the building structure or maintaining its overall structural integrity. That is, a non load-bearing wall serves only to enclose and separate areas of a building. An example of such a wall may be found defining the exterior of a building; however, not all exterior walls are non load-bearing.

Corner wall structure: a structure forming a generally vertical intersection of two building walls which are disposed relative to each other at any angle other than 180 degrees.

Finish wall structure: materials assembled and applied adjacent a surface of a wall having the principal function of concealing the interior structure and providing a desirable outside appearance of the surface. Such materials may include brick, stone, concrete panels, stucco, wood, and etc.

Corner drift connector: a device which allows reversible and non-destructive relative horizontal motion between two walls which meet at a corner.

Figure 2:
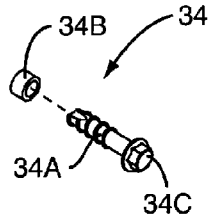
FIG. 2 is an exploded pictorial view of a connector assembly used in one embodiment.
Figure 2A:
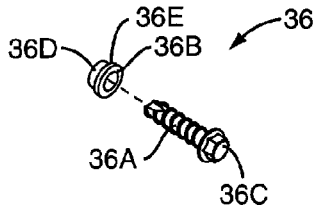
FIG. 2A is an exploded pictorial view of an alternate connector assembly used in one embodiment.

Referring to the FIG. 1, the present invention includes a corner drift connector, indicated generally by the numeral 10, associated with a plurality of connector devices. Corner drift connector 10 includes a pair of flanges 12 and 14 extending at an angular relationship with each other and forming a generally vertical juncture 18. A series of spaced-apart slots 16 is disposed in each of flanges 12 and 14 and oriented generally horizontally relative to juncture 18. Slots 16 may be of any length, but are preferably up to about 6 inches long. Slot 16 may be of any width suitable for engaging the connector devices as further described below. In one embodiment the connector devices comprise shouldered connectors indicated generally by the numeral 32, each including a screw head 32C, a shoulder 32B, and a screw shaft 32A. The length of shoulder 32B is slightly greater than the thickness of flanges 12 and 14. When disposed in slot 16, shoulder 32B is slidable along the slot. In another embodiment, illustrated in FIG. 2, the connector devices include shouldered connector assemblies indicated generally by the numeral 34, each comprising a bushing 34B and a screw which includes a screw head 34C and a screw shaft 34A. The length of bushing 34B is slightly greater than the thickness of flanges 12 and 14. When shouldered connector assembly 34 is disposed in slot 16, screw shaft 34A penetrates bushing 34B, and the bushing is slidable along the slot. Relative to each of the above two embodiments, diameters of screw heads 32C and 34C are larger than the width of slot 16. In an additional embodiment, shown in FIG. 2A, the connector devices include stepped bushing connector assemblies indicated generally by the numeral 36, each comprising a stepped bushing 36B and a screw which includes a screw head 36C and a screw shaft 36A. Stepped bushing 36B includes a flange 36E and a stepped down portion 36D. The diameters of stepped down portion 36D and flange 36E are such that the stepped down portion can be disposed within slot 16 and the flange can abut corner shift connector 10 and extend above and below the slot. The length of stepped down portion 36D is slightly greater than the thickness of flanges 12 and 14. When stepped bushing connector assembly 36 is disposed in slot 16, screw shaft 36A penetrates stepped bushing 36B, and the stepped bushing is slidable along the slot.

Figure 3:
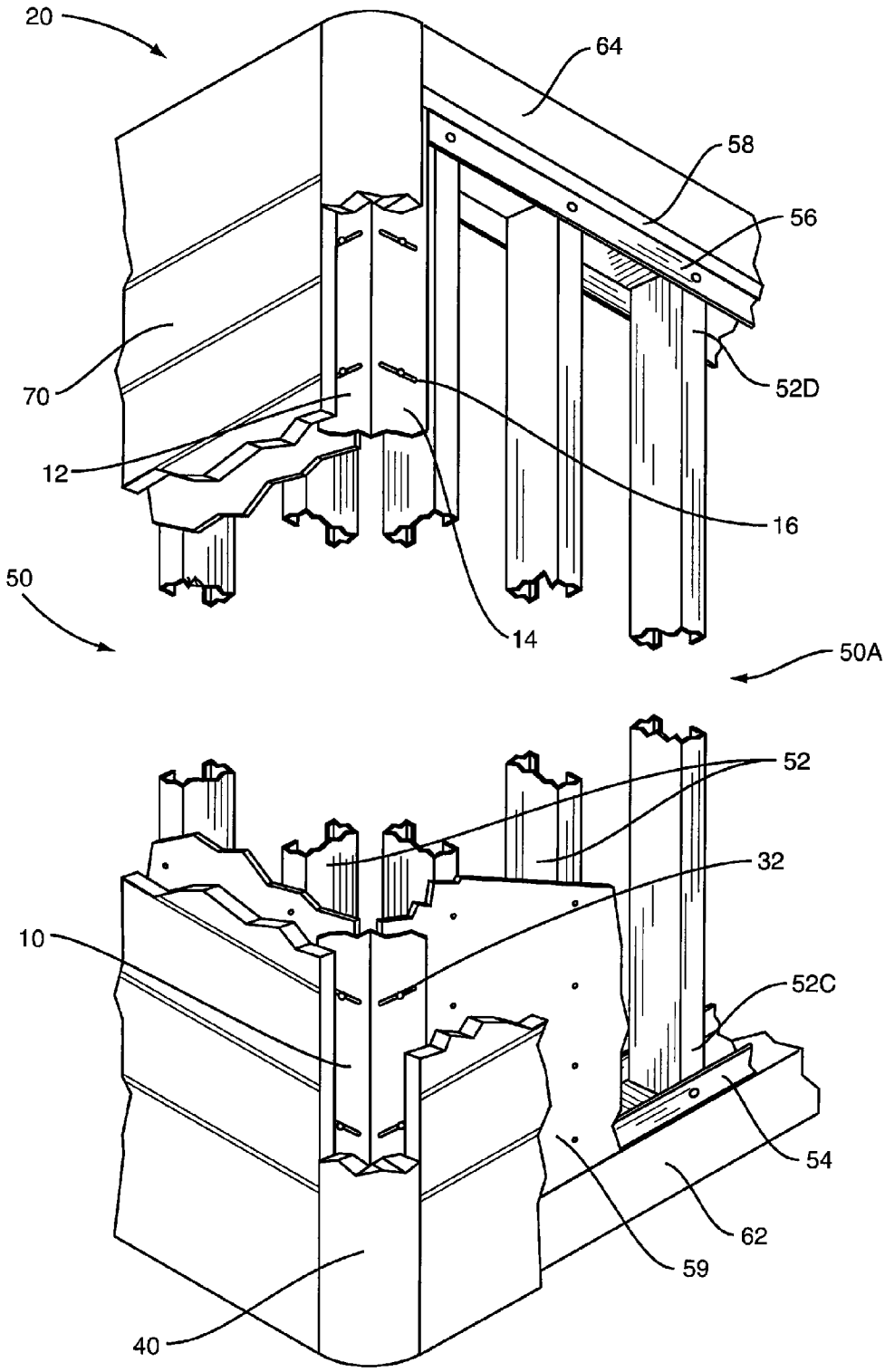
FIG. 3 is a fragmentary pictorial view of a corner wall structure utilizing the corner drift connector.
Figure 4:
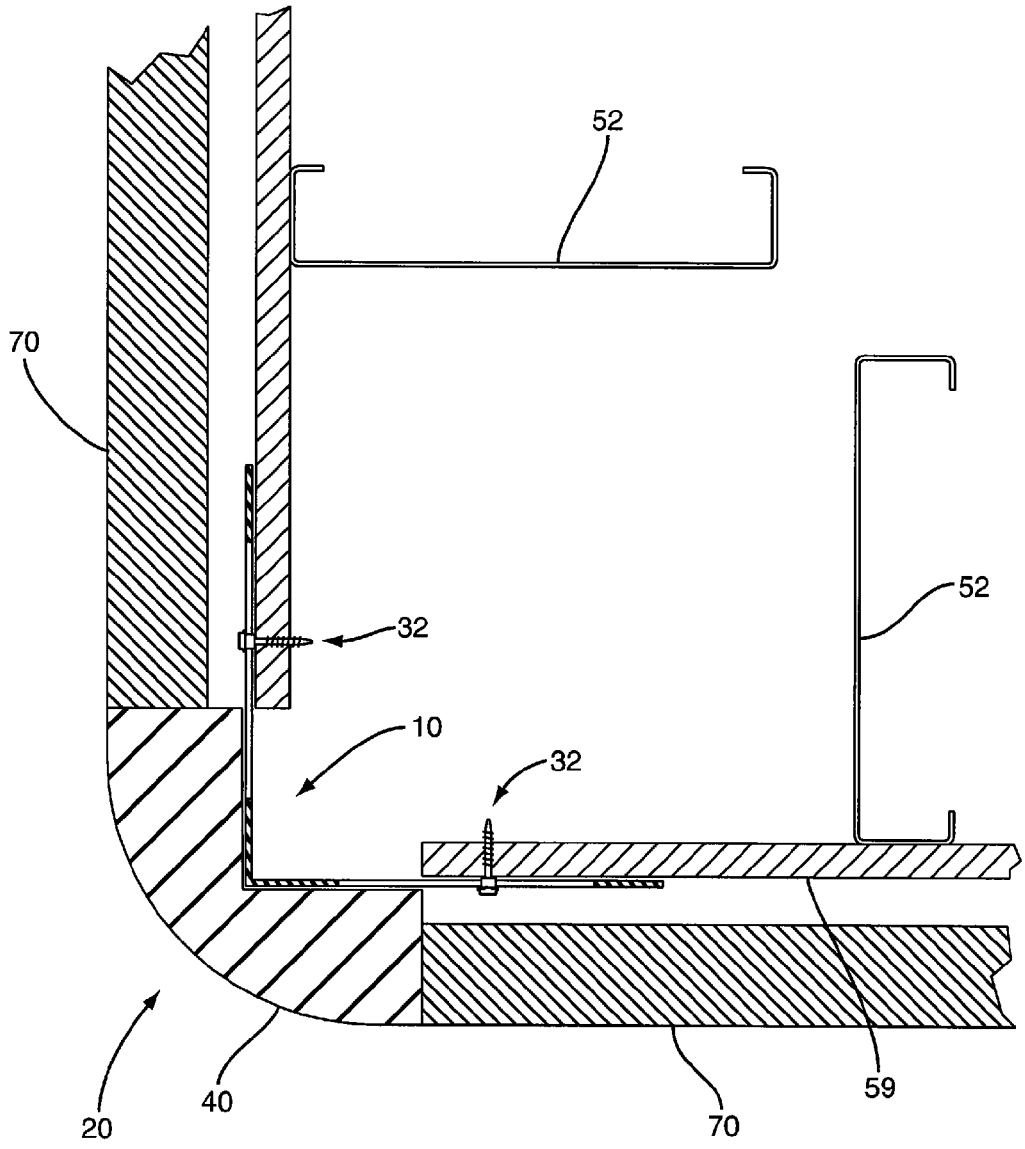
FIG. 4 is a horizontal section view of a corner wall structure utilizing the corner drift connector.

Corner drift connector 10 forms a part of a corner wall structure, indicated generally by the numeral 20 and illustrated in FIGS. 3 and 4. Corner wall structure 20 is a part of a building structure comprising at least a lower floor 62 and an upper floor 64. Floors 62 and 64 are supported by conventional building structural elements such as columns spaced throughout the building. Enclosing a portion of the building are first and second non load-bearing walls 50 and 50A disposed at an angle to each other and engaged with floors 62 and 64. Walls 50 and 50A are spaced apart from each other so that they do not intersect and form a corner; rather, the planes of the walls 50 and 50A intersect, but a gap between the walls is maintained. Each wall 50 and 50A comprises a series of studs 52 spaced apart and oriented generally vertically. Stud lower ends 52C are held in lower track 54, and stud upper ends 52D and held in upper track 56. Lower track 54 is fixedly attached to lower floor 62. Upper track 56 is slidably engaged with upper guide or track 58, and the upper guide is fixedly attached to upper floor 64. Sheathing 59 is attached to studs 52 completing the fundamental structure of walls 50 and 50A.

Corner drift connector 10 is disposed adjacent walls 50 and 50A such that flanges 12 and 14 engage walls 50 and 50A. Flanges 12 and 14 lap sheathing 59 and are fastened thereto by a plurality of connector devices. In one embodiment, the connector devices comprise shouldered connectors 32 which are inserted through slots 16 such that screw shafts 32A penetrate sheathing 59. Shoulder 32B is thus slidable within slots 16 and flanges 12 and 14 are guided between screw heads 32C and sheathing 59. In another embodiment the connector devices include shouldered connector assemblies 34 which are inserted through slots 16 such that screw shafts 34A penetrate sheathing 59. Bushings 34B are slidable within slots 16, and flanges 12 and 14 are guided between screw heads 34C and sheathing 59. Thus disposed, corner drift connector 10 extends between, and is slidably connected to, walls 50 and 50A. Corner drift connector 10 is thus secured to sheathing 59 while slidable relative to the sheathing.

Walls 50 and 50A are finished by applying one or more finish wall structures 70 to the walls. Finish wall structures 70 may be connected to walls 50 and 50A by any of a number of conventional means. Connection of finish wall structures 70 may include spacing the finish wall structures outwardly from sheathing 59 to provide an air space therebetween. Finish wall structures 70 may comprise bricks, stone, wood, or other decorative material. The finish wall structures 70 extend to the vicinity of corner drift connector 10, but may not intersect. Rather, spacing is maintained around the corner and between the finished wall structures 70 of the two walls 50 and 50A. This spacing is a gap which permits the finished wall structures 70 to move relative to each other and allows changes in the gap between walls 50 and 50A and between the finished wall structures of the walls.

The gap, or space, between the finished wall structures 70 is concealed by a cover 40 disposed outside corner drift connector 10 and engaged with the finish wall structures. In one embodiment, cover 40 is constructed of a flexible, compliant material and is sealed or otherwise fixedly attached to finished wall structures 70 by utilizing an adhesive. In another embodiment, cover 40 is attached to corner drift connector 10, and portions of the cover may lap outside finish wall structures 70 sufficiently to conceal any gap occurring at the corner. Thus installed, cover 40 conceals corner drift connector 10 and areas of sheathing 59 adjacent the corner drift connector.

Corner wall structure 20, described above, functions to prevent corner damage which may result from high winds, earthquakes, or other building-deforming events. Damage is prevented by the accommodating relative motion between walls 50 and 50A with flexibility of corner wall structure 20 as further described herein. Relative horizontal motion, or drift, as a result of such events, occurs between lower floor 62 and upper floor 64 occurs, and walls 50 and 50A move relative to each other. More particularly, when the relative motion of the floors 62 and 64 is directed horizontally and parallel to wall 50A, walls 50 and 50A move in different ways. Wall 50A drifts horizontally and in-plane, moving with lower floor 62 and sliding relative to upper floor 64. Wall 50 tilts in the direction of the relative motion because upper stud ends 52D in wall 50 move with upper floor 64 while lower stud ends 52C move with lower floor 62. Thus, wall 50A drifts away from the corner while wall 50 tilts, forming a generally triangular gap between the walls. Slots 16 in flanges 12 and 14 of corner drift connector 10, however, allow connector devices 30 to slide therein, maintaining the connection of flanges 12 and 14 to gapped-apart walls 50 and 50A and thus assuring the integrity of corner wall structure 20. Moreover, cover 40 keeps corner drift connector 10 and the gap between walls 50 and 50A concealed. In one embodiment, cover 40 deforms to keep to concealment of the corner intact, while in another, a portion of the cover laps finish wall structure 70 sufficiently to keep the gap concealed. When the building-deforming event ends, the floors return their original alignment. The slidable connection of corner drift connector 10 to walls 50 and 50A allow the walls to return to their original angular orientation to each other, and the corner is undamaged. Thus, after a high wind, seismic, or other building-deforming event, the slidable connections included in corner wall structure 20 allow the corner to be reversibly deformed and return to its original shape in an undamaged condition.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

The invention claimed is:

1. A corner wall structure that forms a part of a building structure comprising:

a. a first non load bearing wall attached to the building structure and extending in a first lateral direction;

b. a second non-load bearing wall attached to the building structure and extending in a second lateral direction at an angle with respect to the first wall;

c. a corner drift connector slidably connected between the first and second walls such that the walls may move laterally with respect to the corner drift connector and with respect to each other;

d. first and second generally horizontally oriented slots formed in the corner drift connector; and e. first and second fasteners extending through the first and second generally horizontally oriented slots for slidably connecting the first and second non-load bearing walls to the corner drift connector such that both the first and second non-load bearing walls can move generally laterally with respect to the corner drift connector.

2. The corner wall structure of claim 1 wherein the fasteners comprise shouldered connectors or connector assemblies passing through the slots and penetrating portions of each wall such that a shouldered area of each connector or connector assembly slides within a slot.

3. The corner wall structure of claim 1 wherein the corner drift connector comprises a plate having a first flange disposed at an angle to a second flange.

4. The corner wall structure of claim 3 wherein a plurality of the slots is disposed in each flange.

5. The corner wall structure of claim 1 including a compliant corner cover disposed adjacent the corner drift connector and a finish wall structure.

6. The corner wall structure of claim 1 including a corner cover disposed outside of the corner drift connector.

7. The corner wall structure of claim 6 wherein the corner cover is made of a compliant material.

8. A method of assembling a corner wall structure including first and second non load-bearing walls and a corner drift connector slidably connected to the walls, the method including:

a. attaching the first wall to a building structure such that the first wall is supported by the building structure and extends laterally in a first direction;

b. attaching the second wall to the building structure such that the second wall is supported by the building structure and extends laterally in a second direction relative to the first wall;

c. slidably connecting the corner drift connector to the first wall;

d. slidably connecting the corner drift connector to the second wall; and, e. wherein slidably connecting the corner drift connector to the first and second walls includes extending first and second fasteners through first and second generally horizontally oriented slots in the corner drift connector and connecting the fasteners to the first and second walls respectively such that the first and second walls can move horizontally with respect to the corner drift connector.

9. The method of claim 8 wherein the first and second walls include studs slidably connected to a first portion of the building structure and fixedly connected to a second portion of the building structure.

10. The method of claim 9 wherein the studs are fixedly connected to a floor of the building and wherein the studs are movable relative to an adjacent floor of the building.

11. The method of claim 8 wherein the first and second walls include sheathing, wherein the corner drift connector includes first and second flanges each including a plurality of horizontal slots, and wherein slidably connecting the corner drift connector to the walls includes placing the first and second flanges outside the sheathing, inserting the fasteners through slots in the flanges and into the sheathing thereby securing the flanges to the sheathing while permitting relative motion between the flanges and the sheathing, and wherein the fasteners include shouldered connectors or shouldered connector assemblies.

12. The method of claim 8 including applying a finish wall structure to each wall and applying a corner cover such that the corner cover is disposed outside the corner drift connector and adjacent the finish wall structures.

13. The method of claim 8 including applying a finish wall structure to each wall and applying a flexible corner cover outside the corner drift connector such that the flexible corner cover adjoins portions of the finish wall structures.

14. The method of claim 8 including applying two finish wall structures, one to each wall, and extending a cover between the two finish wall structures and outside the corner drift connector.

15. A method of reducing damage to corners of a building comprising:

a. slidably connecting a corner drift connector to a first non load-bearing wall of the building;

b. slidably connecting the corner drift connector to a second non load-bearing wall which is disposed at an angle to the first wall; and, c. thereby forming a corner between the two non load-bearing walls wherein relative horizontal motion between the walls and between each of the walls and the corner drift connector may occur.

16. The method of claim 15 wherein forming a corner between the two non load-bearing walls includes extending the corner drift connector between the first non load-bearing wall and the second non load-bearing wall and slidably connecting flanges of the corner drift connector to the non load-bearing walls.

17. The method of claim 15 wherein the corner drift connector includes first and second flanges disposed at an angle to each other and wherein each flange includes a series of slots and further wherein slidably connecting the non load-bearing walls to the corner drift connector includes utilizing a plurality of connecting devices, each of which extends into a slot and engages one of the walls.

18. The method of claim 17 wherein the connecting devices include shouldered connectors or shouldered connector assemblies and wherein extending a connecting device into a slot includes disposing a shouldered portion of the connector or connector assembly in the slot and wherein engaging a wall includes penetrating a portion of the shouldered connector or connector assembly into a portion of the wall.

19. The method of claim 15 including applying finished wall structures to the non load-bearing walls and extending a cover between the finished wall structures and outside the corner drift connector thereby concealing the corner drift connector.

* * * * *